US005367232A

United States Patent [19]

Netherton et al.

[11] Patent Number: 5,367,232

[45] Date of Patent: Nov. 22, 1994

[54] SUSPENDED MOVING TARGET SYSTEM

[76] Inventors: Ronald R. Netherton, 409 Kolb Rd.; James E. Majka, 196 Hayes Rd., both of Binghamton, N.Y. 13905

[21] Appl. No.: 52,640

[22] Filed: Apr. 23, 1993

[51] Int. Cl.[5] ..... H02P 7/14

[52] U.S. Cl. ..... 318/3; 318/6; 318/9; 273/313; 273/366

[58] Field of Search ..... 273/313–316, 273/318–319, 317, 327–328, 331, 348, 351, 359, 366, 367, 368, 406, 407–408; 40/411–425; 373/85 A, 85 B, 85 C, 85 D, 85 G; 318/3, 9, 6–7, 10–11, 14

[56] References Cited

U.S. PATENT DOCUMENTS

| | | | |
|---|---|---|---|
| 3,388,910 | 1/1965 | Hurta | 273/101 |
| 3,406,969 | 10/1968 | Tisdell et al. | 273/1 |
| 3,554,547 | 1/1971 | Vedeen | 273/85 |
| 3,722,376 | 3/1973 | Wech | 318/592 X |
| 4,076,247 | 2/1978 | Kim et al. | 273/105.6 |
| 4,410,844 | 10/1983 | Plenzler | 318/280 |
| 4,738,223 | 4/1988 | Andreasen | 273/366 X |
| 4,830,351 | 5/1989 | Stanislaw | 270/31 |
| 4,890,847 | 1/1990 | Cartee et al. | 273/406 |
| 4,945,293 | 7/1990 | Wittkopf et al. | 318/7 |
| 5,255,629 | 10/1993 | Paterson | 273/366 X |

*Primary Examiner*—William M. Shoop, Jr.
*Assistant Examiner*—David S. Martin

[57] ABSTRACT

A portable motorized system of pulleys and cable which moves a three dimensional, or conventional target around a predetermined path. The purpose of this system is to simulate, through movement, the actions of an animal during hunting conditions. This system allows the user, to shoot at a target which moves and changes directions, while standing in one place. The system is suspended by attaching screwhooks into fixed objects such as trees, poles, buildings etc. A motor assembly which is attached to one of the supports turns a drive pulley. The cable and target are moved through a series of idler pulleys, by the drive pulley, around a closed circuit. A hand operated ratchet is utilized at another support location to apply tension to the system. The tension causes the system to be fully suspended from the supports. The motor is powered by a twelve volt battery, a switch and fuse are also incorporated. In addition a power interrupter switch, or kill switch, may be introduced between the power supply and the system switch allowing the user to operate the system from the firing line. This system is intended to be used indoors or outdoors and may be set up on an outdoor walk through target range.

17 Claims, 4 Drawing Sheets

SUSPENDED MOVING TARGET SYSTEM

BACKGROUND OF THE INVENTION

The system relates to systems for moving targets along a predetermined path to closely simulate live animals. This particular system will mainly be used by archers or bowhunters, but firearms hunters may also improve their shooting skills by using this system. When an archer or bowhunter practices he or she generally shoots a group of arrows at the target then walks up and retrieves them. This procedure is repeated many times until precision is improved. Generally practice ranges utilize standard three dimensional targets which remain stationary when shot at. Although this has been the usual way which bowhunters practice it does not simulate actual hunting conditions. The user of this system will greatly increase precision and shot placement skills in a much shorter period of time, while becoming more proficient when actually hunting game animals.

SUMMARY OF THE INVENTION

The present invention provides a system which moves weighted targets along a predetermined path. Another object of the system is to closely simulate a live animals movements. This is accomplished by the rotation of a cable around various pulleys with a target suspended from the cable. The target is attached to the cable by using screwhooks, wire and clips. The clips are fastened to the cable by mechanically compressing them over the cable. The clips are configured in such a way as to allow them to revolve around the pulleys, while carrying the attached target, without binding or stopping the motion of the system. The drive unit of the present invention utilizes a two speed, low R.P.M. gear configured electric motor and transmission which is mounted to a support arm using bolts and hex nuts. The motor turns a drive pulley which is mounted to a drive shaft. The drive pulley is connected to the drive shaft by using a rod coupler which is screwed onto the threaded shaft. The drive pulley incorporates an allen head locking device, when tightened places pressure against the rod coupler thus securing the drive pulley to the shaft. The drive motor is a low voltage type which is powered by a twelve volt battery source. The battery source is not a part of the present invention. As an alternative if a supply of power from a central power utility is available, the drive motor may be powered by a battery eliminator. The battery eliminator utilizes a power cord, and a transformer to change alternating current to direct current. The power cord has a plug connected to it, which in turn is plugged into a service outlet from which the power is supplied from a central power utility company. The current which flows through the electrical wire from the power source is regulated by a multi-position switch. The switch is mounted in a moulded, weatherproof, receptacle box which is located near the motor assembly. A replaceable inline fuse is utilized to eliminate the possibility of damage to the system. Flexible conduit is utilized to protect the exposed wiring between the motor assembly and the switch box. The cover plate can be removed from the box in order to service the switch or replace the fuse. Alligator type clamps are included in order to connect the electrical supply cord to the power source. In addition a power interrupter type switch may be introduced between the power source and the system switch. This switch shall be configured as to be operable with a foot, leaving the hands free to perform the desired functions for which the system was designed. A drive cable is stretched over the drive pulley and over a series of remote pulley assemblies in order to create the path which the target will follow, The motor assembly arm and the idler pulley arms are attached to solid vertical supports by utilizing open type screws hooks. The support arms have fabricated holes in their ends which allow the arms to be mounted to the open hooks by first screwing the hooks into the supports and then hanging the arms on the hooks. The tension assembly arm also comprises of an idler pulley, although this arm is much shorter than the aforementioned support arms. A closed type screw hook is mounted in the solid vertical support, at the location of the tension arm pulley assembly, and a nylon web tension ratchet with metal hooks, provides the connection from the tension pulley arm to the closed screw hook. A fabricated hole in the end of the pulley arm allows the ratchet hook to make the connection from the pulley arm to the ratchet. The ratchet is tightened and the entire system becomes suspended by the force exerted from the ratchet. The cable is configured as a closed loop and is spliced at the ends by the using a piece of tubular material. The tubular material is crimped and forms a butt splice which creates friction, of sufficient strength, between the cable and the splice material, to withstand the tensional forces imposed on the system. The connections of the support arms, to the solid vertical supports, are designed to allow them to cant when the weight of the target reaches the location of the each pulley assembly. All pulleys utilized in the system are oriented in the horizontal position. The design and construction of the support arms provides a modular system of mounting and dismounting them from the solid vertical supports. The use of the tension ratchet eliminates the need for the supports to be an exact distance from each other. The ratchet is tightened and the slack in the cable is reduced causing the system to become suspended and operational.

DETAILED DESCRIPTION OF THE INVENTION

Figure 1:
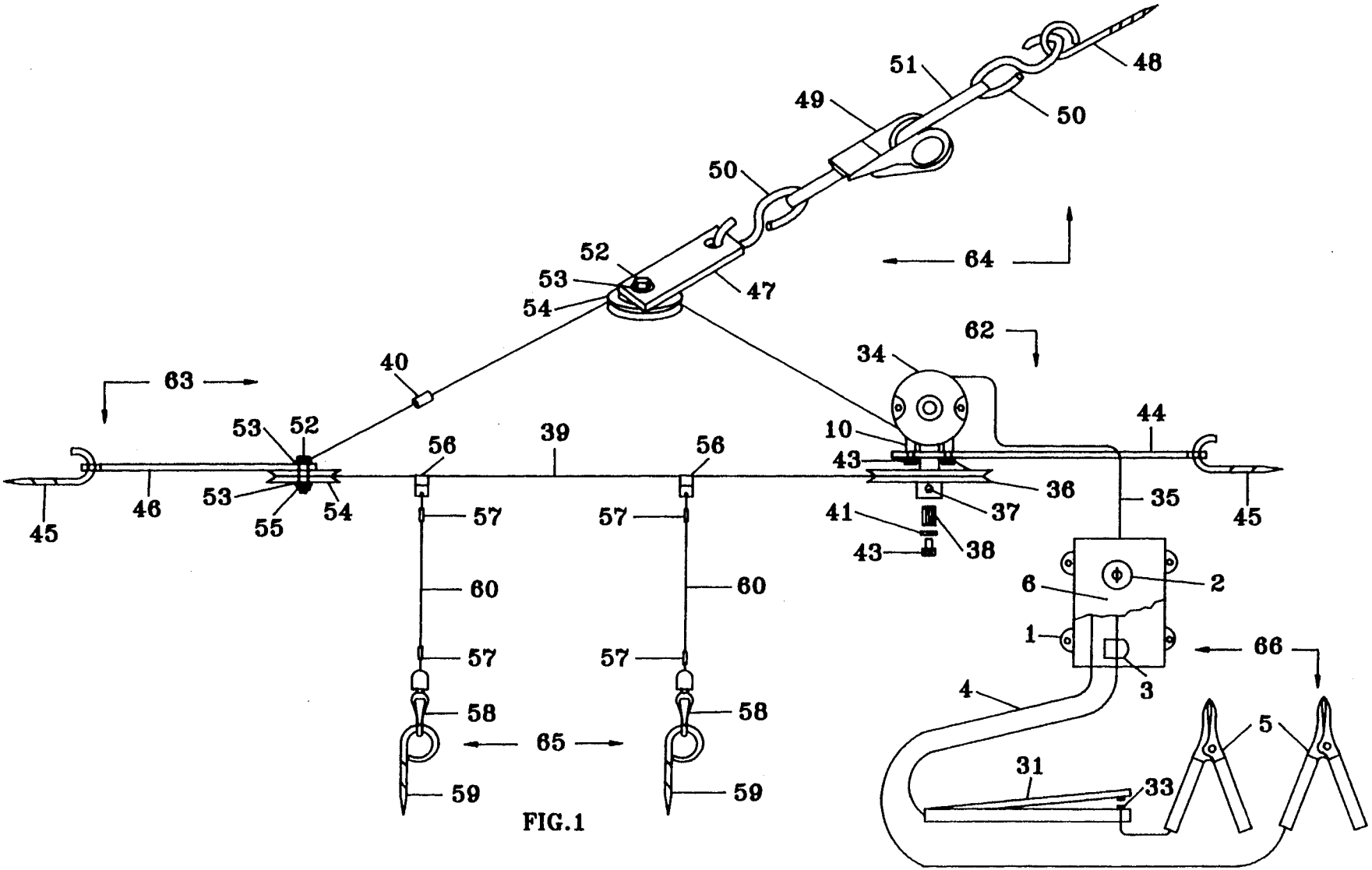
FIG. 1 is a partial perspective view and partial side elevational view of the overall moving target system of this invention with the cable loop shortened in relation to the system components.

The moving target system of the invention is illustrated in FIG. 1, whereby reference numeral 61 designates the entire system and all components which make up the system. The system comprises of five major components, the power drive motor pulley assembly 62, the idler pulley assembly 63, the tension ratchet pulley assembly 64, the attachment assembly 65, and the power supply harness 66 which includes the system switch. The attachment assembly 65 is movably connected to the cable loop 39 which is tautly stretched between the power drive motor pulley assembly 62, the idler pulley assembly 63, and the tension ratchet pulley assembly 64 with all assembly arms connected to their corresponding solid vertical supports (not shown) when the system 61 is oriented for use. The cable loop 39 is selectively moved by a power drive unit 34, which will be explained in greater detail, and accomplished by stretching said cable loop tautly around the power drive motor pulley assembly 62, the tension ratchet pulley assembly 64 and the idler pulley assembly 63.

Power Drive Motor Pulley Assembly

Figure 2:
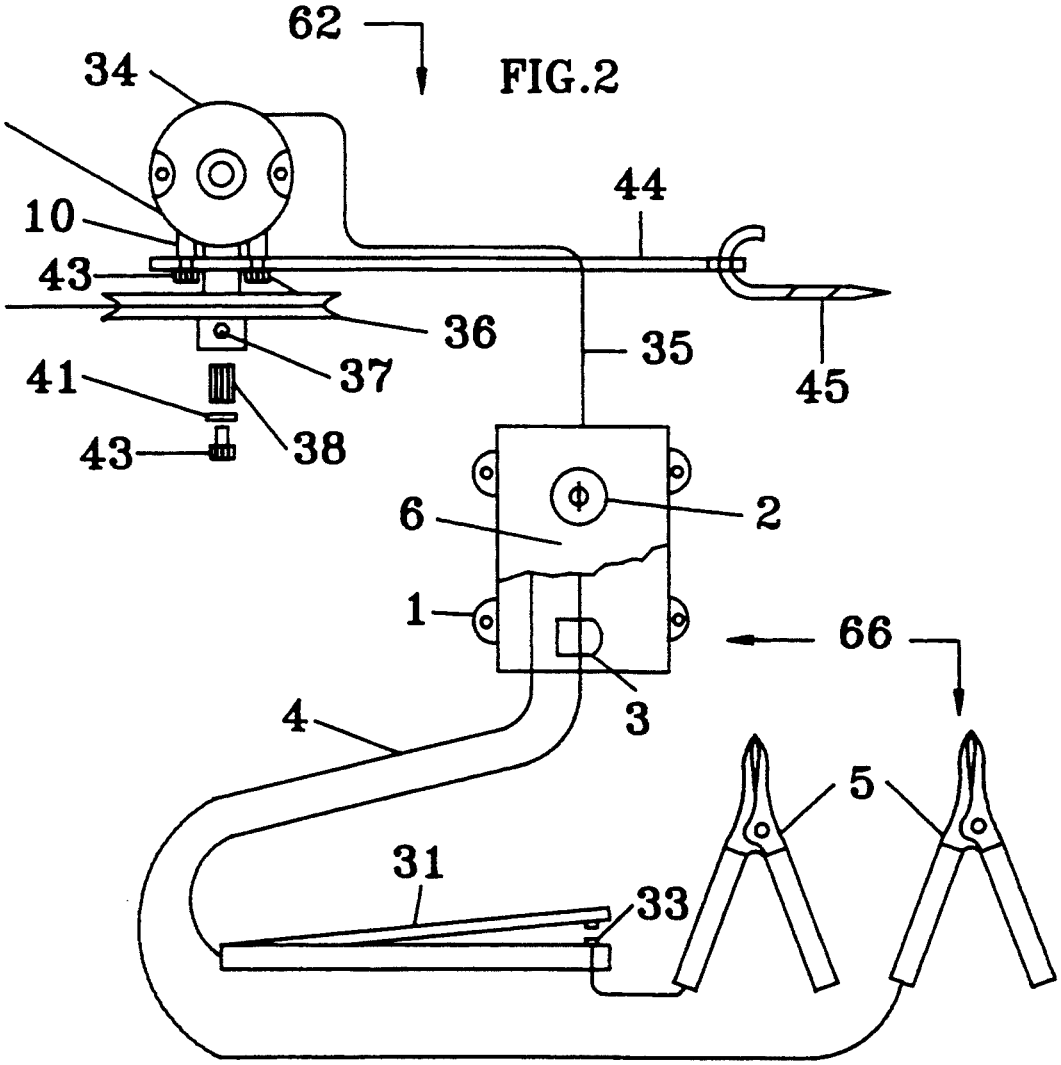
FIG. 2 is a side elevational view of the power drive motor pulley assembly and a front elevational view of the power supply harness.
Figure 5:
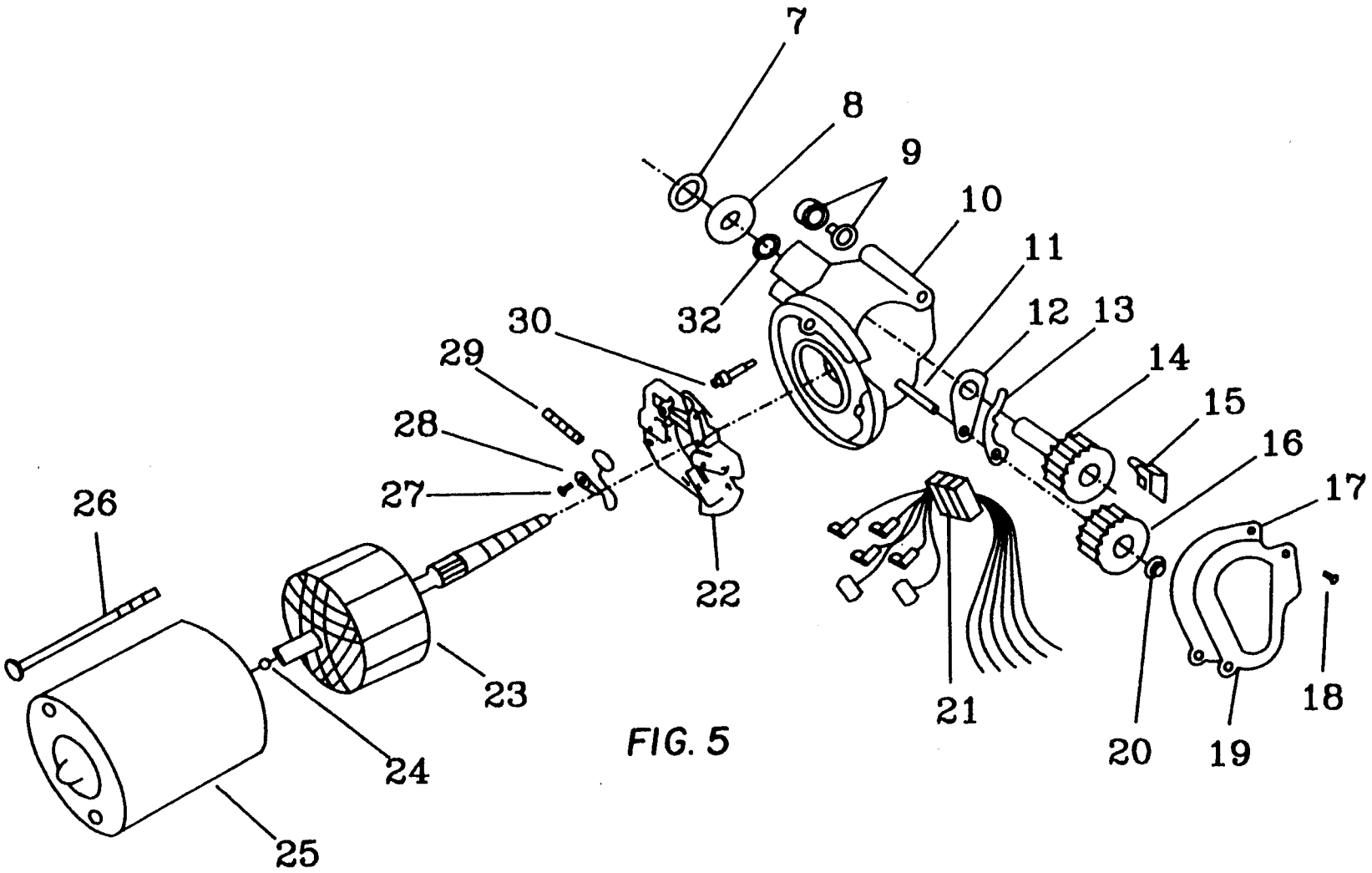
FIG. 5 is an exploded perspective view of a conventional motor and transmission with a legend shown for illustrative purposes.

As shown by reference to FIG. 2 the power drive motor pulley assembly 62 includes a motor and transmission 34, which is mounted to a support arm 44, a drive pulley 36 is secured to the output gear shaft 14 by utilizing a locking device 37, which is fabricated into the body of the drive pulley 36. The support arm 44 is secured to a solid vertical support (not shown) by attaching to an open screw hook 45. The open screw hook 45 is mounted by embedding the threaded portion into the solid vertical support (not shown). The support arm 44 is preferably fabricated as a flat section of steel or galvanized metal because steel has a high tensile strength which resists bending and the galvanization will resist corrosion due to weather and water exposure. The support arm 44 has fabricated apertures in the ends (not shown) to allow attachment to the open screw hook 45, and the motor and transmission 34, using hex bolts placed through the apertures in said support arm and into the gear housing 10 and torqued secure. The drive pulley 36 is secured to a rod coupler 38 by first threading the rod coupler 38 onto the output gear shaft 14, then torquing to a magnitude which prevents separation and placing the drive pulley 36 over the rod coupler 38 and rotating the locking mechanism 37 until the pulley is secure. A washer 41 and hex head bolt 43 are utilized as an additional means to secure the drive pulley 36 to the rod coupler 38. The electric motor and transmission 34 is oriented with the output gear and shaft 14 protruding downward, and the drive pulley 36 attached and in a horizontal plane when operable. The drive motor and transmission 34 is a low voltage gear reduction type which when power is supplied the armature 23 rotates at a high speed. The output gear shaft 14 is permanently engaged to the armature 23 and through gear reduction the revolutions per minute of the motor are reduced, which in turn rotates the drive pulley 36 at a slower speed than the armature, as shown in FIG. 5. The drive motor and transmission 34 rotates the drive pulley 36 with the cable loop 39 stretched around the idler pulleys featured in the system 61, with the attachment assembly 65 carrying the target as will be explained in more detail. A motor and transmission suitable for this purpose is a conventional twelve volt direct current motor with sufficient power output generated to rotate the drive pulley 36, cable loop 39 and weighted target (not shown) around the circuit at an adequate speed. The driven cable loop 39 rotates the target and attachment assembly 65 through a series of idler pulleys around a predetermined closed circuit with the target starting at a fixed position. If allowed to traverse around the circuit the target will return to the starting position and remain in continuous motion until the system power is terminated.

Idler Pulley Assembly

Figures 3, 4:
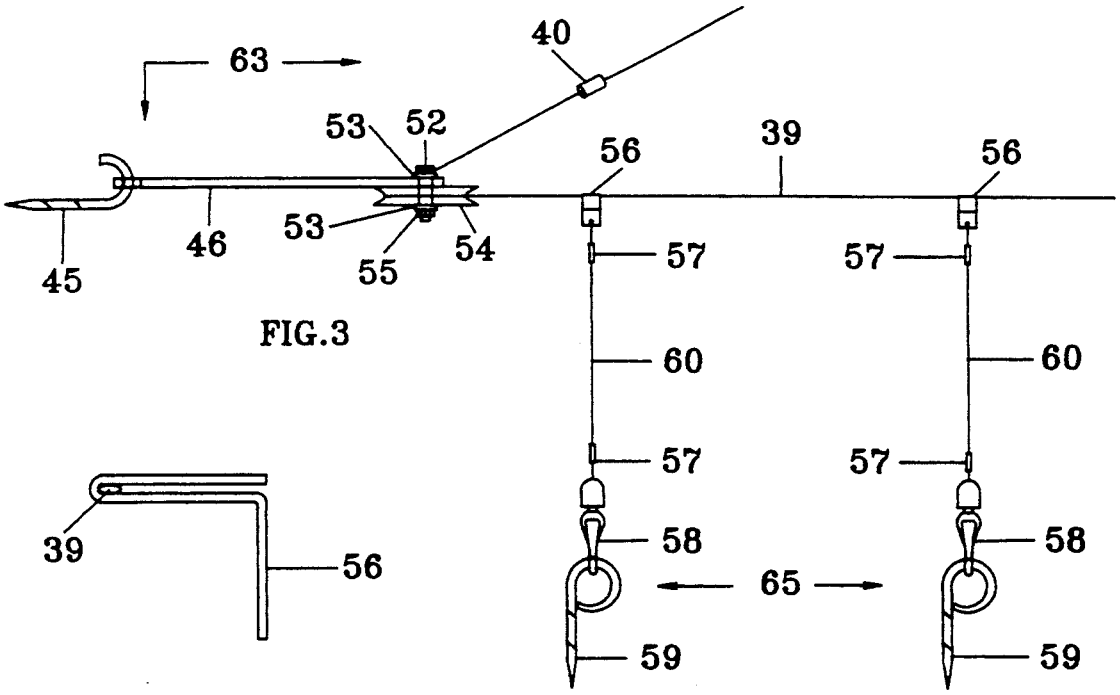
FIG. 3 is a side elevational view of the idler pulley assembly and a front elevational view of the attachment assembly.
FIG. 4 is a side elevational view of the configuration of the target cable clip connection to the cable loop.

The idler pulley assembly 63 comprises of three major components, a ball bearing type idler pulley 54, a support arm 46 and a open type screw hook 45 which is utilized to provide the connection from the support arm 46 to the solid vertical support (not shown) as shown in FIG. 3. The open screw hook 45 is embedded into the solid vertical support to a depth which provides enough resistance to counteract the tensional forces imposed on the support arm 46, whereby the idler pulley assembly 63 remains in equilibrium. The support arm 46 is constructed with fabricated apertures (not shown) in each end, said apertures allow the idler pulley 54 and open type screw hook 45 to become affixed. The support arm 46 is attached to the open screw hook by orienting said hook with the open portion protruding through the corresponding aperture. In the pulley end of the support arm 46 another aperture is also fabricated to allow the idler pulley 54 to become affixed. The idler pulley 54 is attached to the support arm 46 by utilizing a hex head bolt 52, a nut 55, a washer 53, whereby the hex bolt 52 is inserted through the aperture in the support arm 46 and the aperture located in the center of the ball bearing type pulley 54 simultaneously. The nut 55 is threaded onto the hex head bolt 52 at a point in time when the apertures in the idler pulley 54 and support arm 46 have identical axes and the corresponding surfaces are adjoining, and torqued to a magnitude which prevents dispersement. The idler pulley 54 is manufactured with ball bearings (not shown) oriented to allow the grooved outer portion of the pulley to rotate while the central body remains stationary, when being driven by the cable loop 39. The cable loop 39 is driven by the motor and transmission 34 around the idler pulley 54, whereby the idler pulley acts as a pivot point in the predetermined circuit, whereby the cable loop 39 and target (not shown) can change direction.

Power Supply Harness

The power supply harness 66 comprises of two major components, an outlet box 1 and switch cover 6 and a power interrupter switch 31 as shown in FIG. 2. The outlet box 1 and cover 6 are preferably made of moulded impact resistant plastic because plastic is light in weight, non corrosive, stable and has electrical insulating properties. The outlet box 1 is preferably mounted near the power drive motor pulley assembly 62 with the switch cover 6 secured to the face of said box, whereby the outlet box 1 is attached to a support by utilizing threaded wood screws (not shown) embedded into a solid vertical support (not shown) such as a tree, pole or stud wall. Electrical current flow to the motor and transmission 34 is controlled by a system switch 2 and a power interrupter switch 31 with the system switch being mounted in the outlet box cover 6 and protruding outward. The system switch 2 is electrically connected by conventional wiring (not shown) to a battery (not shown) and a motor and transmission 34. A portion of flexible conduit 35 is utilized to protect the external wiring between the outlet box 1 and motor and transmission 34. The system switch 2 is a three position switch with the middle position being the off position, the right or left positions being each of two separate speeds which the motor and transmission 34 can be driven. Placing the system switch 2 in the center position will terminate the current flow from the battery (not shown) to the motor and transmission 34. Placing the switch in either the left or right position regulates the electrical current accordingly and the drive pulley 36 will drive the cable loop 39 at the desired speed around the predetermined circuit. The electrical current is transferred from the battery (not shown) to the power supply cord by utilizing alligator type post clamps 5. A fuse 3 of sufficient amperage is utilized to protect the motor and transmission 34 from electrical damage, and spliced in the positive power supply cord in between the battery and system switch 2. The power interrupter switch 31 utilizes electrical contacts 33 which selectively allow current to flow from the battery to the system switch 2 and is operated by the user at the firing line. Thus by selectively joining the contacts 33 with the system switch in one of the on positions the cable loop 39 and target (not shown) can be driven around the predetermined circuit by the drive pulley 36 and started or stopped in an instant by separating or uniting the contacts 33.

Tension Ratchet Pulley Assembly

The tension ratchet pulley assembly 64 comprises of three major components, the tension ratchet 49, the support arm 47 and the idler pulley 54 as shown in FIG. 1. The idler pulley 54 is of the identical type which was described earlier in this description, said pulley being a ball bearing type pulley with a fabricated aperture present in the center. The support arm 47 is shorter in length than the aforementioned support arms in this description, but made of similar material such as flat bar steel. The support arm 47 has fabricated apertures in each end which allow the idler pulley 54 to become affixed to one end and the tension ratchet "s" type hook 50 to become affixed to the opposing end. The idler pulley 54 is secured to the support arm 47 in the identical manner as described earlier in this description by utilizing a hex head bolt 52, a washer 53 and a nut 55, whereby the corresponding apertures are aligned on identical axes and the hex head bolt 52 is inserted through said apertures and secured with the nut 55 and torqued to a magnitude which prevents dispersement. The ratchet "s" hook 50 is secured to the support arm 47 by orienting it to be inserted through the aperture in the corresponding end of the support arm 47 with said hook protruding through said aperture. The tension ratchet 49 comprises of a web type material 51, whereby said "s" type hooks are affixed to each end by stitching or sewing and the material is preferably made of nylon because of nylon's strength, flexibility, light weight and ease of handling. A closed type screw hook 48 is utilized to connect the ratchet's "s" type hook 50 to a solid vertical support (not shown) , whereby said closed screw hook 48 is embedded into the support to a depth which will resist the tensional forces imposed on the system 61 when the tension ratchet 49 is levered. The ratchet's "s" type hook 50 is oriented with the open portion protruding through the aperture in the closed screw hook 48 and a rigid connection is obtained when the tensional force is imposed by the ratchet 49. The ratchet 49 is levered when all assemblies are oriented and affixed to their corresponding supports, whereby a tensional force is imposed on the cable loop 39 from the shortening of the strap material 51. All assemblies in the system 61 become suspended at the pulley locations excluding where said assemblies are affixed to their corresponding solid vertical supports (not shown). The power is allowed to flow through the system switch 2 to the motor and transmission 34, whereby said motor rotates the drive pulley 36 , and the drive pulley drives the cable loop 39, with the target attached, around the predetermined circuit.

Attachment Assembly

The attachment assembly 65 comprises of five components, the target cable clips 56, the support wire 60, the wire crimps 57, the snap hooks 58, and the closed screw hooks 59, as shown in FIG. 3. The target cable clips 56 are oriented as to encompass the cable loop 39 as shown by FIG. 4, whereby said clips are mechanically compressed in a manner which bonds them to the cable loop 39 by the creation of a frictional force between the surfaces of the cable loop 39 and the cable clips 56. The clips are fabricated as to allow free passage around all pulleys featured in the system 61 without binding or stopping said system. The support wire 60 is inserted through fabricated apertures in the end of the cable clips 56 and secured by utilizing wire crimps 57, whereby said crimps are oriented to encompass the support wire 60 at the point in time when a compression force is applied to the crimps 57, said force prevents the wire 60 from moving or slipping when the weight of the target is introduced. The opposing end of the support wire 60 is connected to the snap hooks 58 by inserting said wire through fabricated apertures in the snap hooks 58 and securing said wire in the identical manner as described earlier in this description by utilizing wire crimps 57. The snap hooks 58 are manufactured with a means of opening and closing, whereby they can be attached and detached very quickly to the closed screw hooks 59, whereby said closed screwhooks are embedded into the target material. The closed screwhook 59 is embedded to a depth which prevents separation of said hook and said target. The snap hook 58, closed screwhook 59, support wire 60, wire crimps 57, and target cable clips 56 provide a physical connection between the target (not shown) and the cable loop 39. This assembly 65 is designed to suspend one or more targets while the cable loop 39 is driven by the drive pulley 36 around the predetermined circuit, whereby the cable loop 39 is tautly stretched around all pulleys featured in the system 61.

Installation Operation and Summary

The moving target system 61 of this invention may be installed indoors or outdoors easily and in a short period of time where suitable solid vertical supports are present. This system can be utilized inside a building by attaching the support arms and corresponding screw hooks to stud walls, block walls or any material which will assure a rigid connection. The target system 61 of this invention was designed for use on the outdoor archery ranges and has the capability to be setup in a wooded atmosphere, whereby the users of the system can walk and shoot at many systems of this type on one course. Thus by utilizing a multitude of systems of this invention an archery club can hold competitions which involve the use of moving targets which also turn to present not only broadside shots but also quartering shots. The main purpose of this invention is to create a method of practice which will be much more realistic while making it more difficult to obtain perfect scores in such competitions. At the present time the only way which an archery range could make a course more difficult was to place more brush in the archers shooting lanes, whereby most hunters did not feel that they would shoot at a game animal in this situation because a quick, humane kill could not be accomplished. Individual archers, bowhunters or marksman can also utilize this system anywhere solid vertical supports are present and a sufficient area is available to assure safe use of the system. The solid vertical supports need not be any exact distance from each other because the tension ratchet pulley assembly 64 will compensate by reducing the amount of slack in the cable loop 39. The supports must only be within a certain range of distance, thus making the system 61 very versatile. For example if this invention is to be utilized in a wooded atmosphere two supports such as trees must be located, whereby the power motor pulley assembly 62 and idler pulley assembly can become affixed, and a third support must be found or constructed in the vicinity of the first two supports for the tension ratchet pulley assembly to become affixed. The cable loop 39 is tautly stretched around the system pulleys to form the predetermined path which the target will traverse. The installation is accomplished by mounting the power drive motor pulley assembly arm 44, the idler pulley assembly arm 46, and the tension ratchet pulley arm 47 to their corresponding solid vertical supports by utilizing open screw hooks 45, and closed screw hooks 48 embedded in the supports to make a rigid connection. The assembly arms featured in this system are attached to their corresponding solid vertical supports by the insertion of the hooks into the fabricated apertures as was described earlier in this description. The motor and transmission 34 is secured to the support arm 44 using hex head bolts, washers and nuts as was described earlier in this description. The mounting hooks shall be of suitable size and strength, with adequately sized machined threads on their shafts which will properly secure the assembly arms to the solid vertical supports. The open hooks 45 and closed hook 48 must be installed nearly level and at a sufficient height as to allow the target to traverse freely around the system 61. This setup can be accomplished by utilizing a string and string level when installing the screw hooks into the solid vertical supports. The power drive motor pulley assembly 62, idler pulley assembly 63 and tension ratchet pulley assembly 64 are mounted to their corresponding supports and the cable loop 39 is placed around the drive pulley 36 and idler pulleys 54, whereby the ratchet is levered to reduce the amount of slack in the cable loop 39 as was described earlier in this description. The attachment assembly 65 is connected to the cable loop 39 in a manner previously described, whereby said assembly comprises of the target cable clips 56, support wire 60, snap hooks 58, wire crimps 57 and closed screw hooks 59, said assembly suspends the target (not shown) from the cable loop 39. The power supply harness 66 which includes the outlet box 1 and switch cover 6, system switch 2, fuse 3, power interrupter switch 31, alligator type post clamps 5, and electrical wire 4, provides a means which supplies the motor and transmission 34 with electrical current from a power source, being either a battery or a central power utility company. If power from the central power utility is utilized provision can be made to plug the system into an electrical outlet which provides alternating current. The unique mounting arrangement for all assembly arms in this system allows the pulleys to cant when the weight of the target is introduced, the rocking movement of the pulleys allows the cable loop 39 with the attachment assembly 65 and target connected, to traverse smoothly around the predetermined circuit. The moving target system of the present invention is light, compact, and can be easily moved from one location to another in a short period of time by a single person. In operation the target will move at differing speeds and has the ability to pivot at various support locations. By utilizing the target cable clips 56 problems such as cable run off is avoided. The special configuration of the target cable clip 56 allows a weighted target to pass freely around various pulleys, which are oriented in the horizontal plane, while said target is attached to the cable loop 39. The modular configuration of the moving target system 61 will be easily manufactured, have the ability to be installed in almost any suitable situation, and simple to operate. The use of the tension ratchet eliminates the need to have supports located at exact distances, whereby the ratchet will reduce the slack in the cable loop 39 and compensate for the varying distances between supports. By utilizing a system switch 2 and power interrupter switch 31 simultaneously the system 61 can be operated by the user at the firing line. Although the embodiment of the moving target system described previously is designed for use by an archer or bowhunter it may be adapted by changing the target material to cardboard or paper, whereby any firearm can be discharged at the moving target giving the shooter a situation similar to actually hunting. Additions in the number of various assemblies or modifications to the system may be introduced without effecting the scope of the novel concepts of the present invention.

We claim:

1. A portable motorized system for moving and turning at least one target, including at least one power drive unit assembly, at least one tension ratchet pulley assembly, at least one idler pulley assembly, and a drive cable configured as a continuous loop and arranged for being set into motion by the said at least one power drive unit assembly and driven through a series of pulleys;

said at least one power drive unit assembly each containing at least one motor pulley assembly arm and having at least one support arm means with two ends, each end having one or more fabricated apertures through which at one end a motor is attached and at the other end a mounting means is inserted for attachment to a support, the motor through a shaft drives a drive pulley;

said at least one tension ratchet pulley assembly each containing at least one tension ratchet assembly arm having at least one support arm means with two ends, each end having one or more fabricated apertures through which at one end an idler pulley is attached and at the other end a tension ratchet is attached and the tension ratchet is connected to a mounting means for attachment to a support;

said at least one idler pulley assembly each containing at least one idler pulley assembly arm having at least one support arm means with two ends, each end having one or more fabricated apertures through which at one end an idler pulley is attached and at the other end a mounting means is inserted for attachment to a support;

joining means for attachment of the drive cable to form a continuous loop;

attachment means for attaching at least one target cable clip to the drive cable from which the said at least one target is to be attached wherein the said at least one target cable clip is allowed to revolve around the series of pulleys while being attached to said drive cable;

a means for energizing the motor through a line from a power source, the means for energizing contains a system switch for speed selection and at least one power interrupter switch for remote operation.

2. The portable motorized system according to claim 1 further comprises;

a multitude of open type screw hooks attached to the supports in a prearranged pattern;

a multitude of apertures fabricated in the said at least one motor pulley assembly arm, the said at least one tension ratchet assembly arm and the said at least one idler pulley assembly arm whereby all said assembly arms are oriented to become attached to the said multitude of open type screw hooks with the said multitude of open type screw hooks protruding through the said multitude of apertures.

3. The portable motorized system according to claim 1 further comprises;

a support means wherein a tensional force suspends the said at least one power drive unit assembly, the said at least one idler pulley assembly and the said at least one tension ratchet pulley assembly;

a threaded rod coupler secured to said drive shaft of said motor by the presence of machined threads on an inner surface of said threaded rod coupler and on an outer surface of said drive shaft, whereby said threaded rod coupler is torqued to a magnitude which prevents said threaded rod coupler and said drive shaft from dispersing;

a locking device fabricated in the drive pulley body, which when torqued unites said drive pulley body to said threaded rod coupler, said locking device creates a frictional force at a point of surface contact of said threaded rod coupler and said locking device, whereby the locking device prevents separation;

a driving means wherein the rotation of said drive pulley imposes friction on said drive pulley surface and said drive cable surface, whereby said drive cable is driven around said series of pulleys.

4. The portable motorized system according to claim 3 wherein said motor is electrically operated and positioned to drive said drive pulley.

5. The portable motorized system according to claim 1 further comprises;

a system switch to selectively transmit said electrical power from the source to the electric motor and to alter the amount of power which flows through the line.

6. The portable motorized system according to claim 5 wherein said system switch activates and deactivates said electric motor and permits the electric motor to rotate at one or more speeds.

7. The portable motorized system according to claim 6 wherein said electric motor further comprises;

a multi-speed transmission constructed to perform simultaneously with said electric motor, including an idler gear and pinion which when driven by said electric motor limits the speed of an output gear and shaft.

8. The portable motorized system according to claim 1 wherein said drive cable is joined by utilizing a portion of tubular material which is mechanically swagged to induce a frictional force upon the portion of said material and said drive cable, preventing the ends of the drive cable from dispersing.

9. The portable motorized system according to claim 1 wherein the said at least one target cable clip is attached to said drive cable by a means of a mechanical compression force.

10. The portable motorized system according to claim 9 wherein the mechanical compression force is applied to a portion of the said at least one target cable clip, said portion being a metal or synthetic material means configured to become affixed to said drive cable, said mechanical compression force is applied to the portion of material at a point in time when said portion encompasses said drive cable.

11. The portable motorized system according to claim 10 further comprises;

a second portion of said material is fabricated as to form an angle, whereby said fabricated angle in the material allows the said at least one target cable clip to revolve around the said series of pulleys without binding or stoppage of the drive cable, while the said at least one target cable clip is attached to said drive cable;

a means of attaching the said at least one target to the said at least one target cable clip including a fabricated aperture in said second portion of the said at least one target cable clip.

12. The portable motorized system according to claim 1 wherein the said at least one tension ratchet pulley assembly further comprises;

a material means for attachment to the support with two ends, one end is attached to the said tension ratchet and the other end is attached to said support;

at least one s type hook which when used in conjunction with the tension ratchet maintains a tensional force between the ratchet, the drive cable, the material means and the supports.

13. The portable motorized system according to claim 1 wherein the said at least one power interrupter switch remotely regulates the flow of electrical power from the source to the system switch, said at least one power interrupter switch contains at least two contacts which when said contacts are united the flow of electrical power is allowed to flow through the line to the system switch and when said contacts are separated the flow of electrical power through said line is not available to power said system switch.

14. The portable motorized system according to claim 13 wherein the said at least one power interrupter switch is made operable by applying a force to said contacts.

15. The portable motorized system according to claim 1 further comprises;

at least one attachment assembly containing a support material means with two ends, one end is oriented to become affixed to the said at least one target cable clip, and the other end is oriented to become attached to the said at least one target.

16. The portable motorized system according to claim 1 wherein the said at least one idler pulley assembly, the said at least one power drive unit assembly and the said at least one tension ratchet pulley assembly each act as a pivot point, said pivot point being the point in the drive cable where the said at least one target changes direction.

17. The portable motorized system according to claim 1 wherein said mounting means allows the said at least one idler pulley assembly arm, the said at least one tension ratchet assembly arm and the said at least one motor pulley assembly arm to cant when the said at least one target cable clip revolves around said series of pulleys, said series of pulleys being oriented in a horizontal plane.

* * * * *